US009941599B2

(12) United States Patent
Eide et al.

(10) Patent No.: US 9,941,599 B2
(45) Date of Patent: Apr. 10, 2018

(54) THREE BAND WHIP ANTENNA

(71) Applicant: Comrod AS, Tau (NO)

(72) Inventors: Jo Morten Eide, Stavanger (NO); Vidar Bakke, Jorpeland (NO)

(73) Assignee: Comrod AS, Tau (NO)

( * ) Notice: Subject to any disclaimer, the term of this patent is extended or adjusted under 35 U.S.C. 154(b) by 28 days.

(21) Appl. No.: 14/415,630

(22) PCT Filed: Jul. 25, 2013

(86) PCT No.: PCT/NO2013/050124

§ 371 (c)(1),
(2) Date: Jan. 19, 2015

(87) PCT Pub. No.: WO2014/025263

PCT Pub. Date: Feb. 13, 2014

(65) Prior Publication Data

US 2015/0180137 A1 Jun. 25, 2015

Related U.S. Application Data

(60) Provisional application No. 61/680,604, filed on Aug. 7, 2012.

(51) Int. Cl.

| | |
|---|---|
| ***H01Q 21/30*** | (2006.01) |
| ***H01Q 1/08*** | (2006.01) |
| ***H01Q 5/314*** | (2015.01) |
| ***H01Q 21/10*** | (2006.01) |
| *H01Q 9/32* | (2006.01) |

(52) U.S. Cl.

CPC ..... *H01Q 21/30* (2013.01); *H01Q 1/085* (2013.01); *H01Q 5/314* (2015.01); *H01Q 21/10* (2013.01); *H01Q 9/32* (2013.01)

(58) Field of Classification Search

CPC ..... H01Q 21/30; H01Q 21/10; H01Q 1/085; H01Q 9/32; H01Q 5/314

USPC ..... 343/793, 810

See application file for complete search history.

(56) References Cited

U.S. PATENT DOCUMENTS

| | | | | |
|---|---|---|---|---|
| 9,246,224 | B2 * | 1/2016 | Lalezari | H01Q 9/28 |
| 2005/0128158 | A1 * | 6/2005 | Taira | H01Q 21/0006 343/793 |
| 2009/0140939 | A1 * | 6/2009 | Bongfeldt | H01Q 1/1242 343/713 |

(Continued)

FOREIGN PATENT DOCUMENTS

| | | | |
|---|---|---|---|
| EP | 2028719 | A1 | 2/2009 |
| JP | 2003338707 | A * | 11/2003 |
| WO | 2012078566 | A2 | 6/2012 |

OTHER PUBLICATIONS

International Search Report and Written Opinion for PCT/NO2013/050124 dated Nov. 22, 2013.

*Primary Examiner* — Dieu H Duong

(74) *Attorney, Agent, or Firm* — Andrus Intellectual Property Law, LLP

(57) ABSTRACT

A three band whip antenna has a base where the whip antenna along its whole length or part of its length, has a lowest frequency band antenna element and an intermediate frequency band antenna element, wherein a highest frequency band antenna is included in the whip antenna at a position closer to base than the intermediate frequency band antenna element.

13 Claims, 3 Drawing Sheets

(56) References Cited

U.S. PATENT DOCUMENTS

| | | | | |
|---|---|---|---|---|
| 2010/0141545 | A1* | 6/2010 | Pakosz | H01Q 9/285 343/810 |
| 2010/0283699 | A1* | 11/2010 | Apostolos | H01Q 1/3275 343/792 |
| 2012/0119964 | A1* | 5/2012 | Ngo Bui Hung | H01Q 5/00 343/787 |
| 2013/0009832 | A1* | 1/2013 | Apostolos | H01Q 1/273 343/730 |

* cited by examiner

THREE BAND WHIP ANTENNA

CROSS-REFERENCE TO RELATED APPLICATIONS

This application is the U.S. national stage application of International Application PCT/NO2013/050124, filed Jul. 25, 2013, which international application was published on Feb. 13, 2014, as International Publication WO2014/025263 in the English language. The international application is incorporated herein by reference, in entirety. The international application claims priority to U.S. Provisional Patent Application No. 61/680,604, filed Aug. 7, 2012, which is incorporated herein by reference, in entirety.

FIELD

There is provided a three band whip antenna. More precisely there is provided a three band whip antenna having a base, and where the whip antenna along its length or part of its length, has a lowest frequency band antenna element and an intermediate frequency band antenna element.

BACKGROUND

Below, for illustrative reasons, reference are made to the following three bands:

- lowest frequency: L-VHF generally recognized to include the range of 30-88 MHz;
- intermediate frequency: UHF generally recognized to include the range of 225-450 MHz; and
- highest frequency: L band generally recognized to include the range of 1250-2000 MHz.

The above band frequencies are in no way limiting the scope of the invention as other ranges may apply.

As more data signals are transmitted though radio systems, an increasing need for L band antennas has been experienced.

Two band antennas covering the L-VHF and UHF bands have been available for some time. The applicant's antenna VHF30450DB is such an antenna.

In order to avoid having yet another antenna in operation, the antenna manufacturers have experienced interest for a three band whip antenna that in addition to the L-VHF and the UHF also has an L band antenna included.

Problems associated with the inclusion of an L band antenna in a whip antenna may include:

- retaining the characteristics of the L-VHF UHF antenna with the L band antenna added;
- obtaining a good omnidirectional radiation pattern with a high gain for the L band antenna; and
- retain an acceptable diameter for the whip.

SUMMARY

The purpose of the invention is to overcome or reduce at lest one of the disadvantages of the prior art.

The purpose is achieved according to the invention by the features as disclosed in the description below and in the following patent claims.

There is provided a three band whip antenna having a base and where the whip antenna along its whole length or part of its length, has a lowest frequency band antenna element and an intermediate frequency band antenna element, wherein a highest frequency band antenna is included in the whip antenna at a position closer to base than the intermediate frequency band antenna element.

In a whip antenna, it has proved technically simpler to pass a feed conductor by the highest frequency antenna element and to the intermediate frequency antenna element than to pass the feed conductor by the intermediate frequency antenna element and to the highest frequency antenna element.

The structure of the antenna according to the invention thus allows for simpler and less costly filters and antenna matching units to be utilized.

The highest frequency band antenna may have more than one antenna element. The more than one highest frequency band antenna elements may be spaced along a part of the whip.

The highest frequency band antenna elements may be positioned diametrically opposite to a feed conductor. Such a layout will maximise the distance between the antenna elements and the feed conductor.

The highest frequency band antenna elements may be placed symmetrically along the whip antenna relative its feed position.

The highest frequency band antenna elements may be formed as an arch of a circle. The highest frequency band elements may be concave with respect to the feed conductor. Again, the purpose of this layout is to utilize the space in the whip antenna.

At least two of the lowest frequency, intermediate frequency or the highest frequency band signals may be combined prior to or in the base.

At least two of the lowest frequency, intermediate frequency or the highest frequency band signals may be divided prior to feeding the appropriate antenna element.

The signals to all three band antennas may be passed through a single coaxial cable.

In one embodiment, the shield of the coaxial cable constitutes the antenna element of the end feed lowest frequency antenna.

Frequency filters and antenna matching units are well known to a skilled person and are not discussed here.

The three band whip antenna according to the invention provides a high performance antenna with excellent highest frequency band antenna performance in a relatively simple structure that is well suited for manufacture.

BRIEF DESCRIPTION OF THE DRAWINGS

Below, an example of a preferred device is explained under reference to the enclosed drawings, where.

DETAILED DESCRIPTION OF THE DRAWINGS

Figure 1:
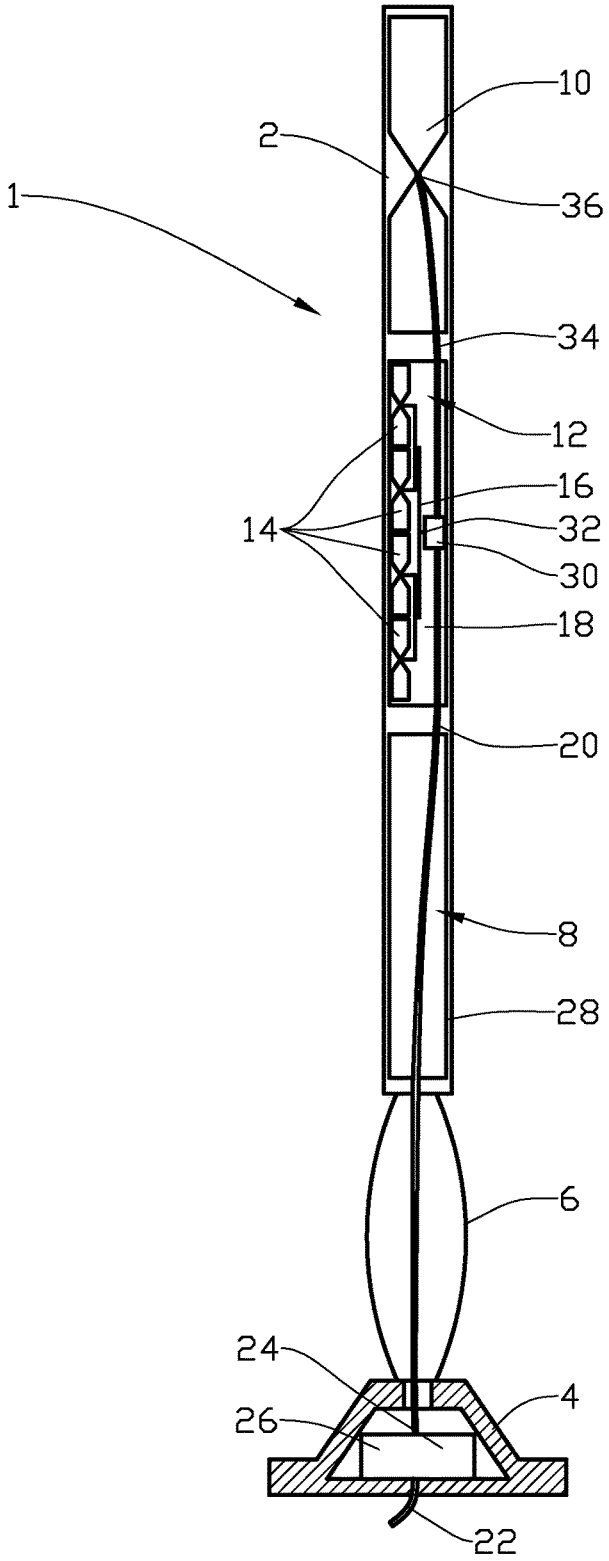
FIG. 1 shows schematically a three band whip antenna according to the invention.

On the drawings the reference number 1 denotes a three band whip antenna, below denoted whip antenna, that has a whip 2 in the form of a non-insulating tube, which is connected to a base 4 via a spring 6.

The whip antenna 1 has an end feed lowest frequency band antenna element 8, here corresponding to the L-VHF band, a dipole intermediate frequency band antenna element 10, here corresponding to the UHF band, at its upper end portion and a highest frequency band antenna 12, here corresponding to the L band, positioned closer to the base 4 than the intermediate frequency band antenna element 10.

The highest frequency band antenna 12 includes four dipole highest frequency band antenna elements 14 that are symmetrically spaced relative to their feed position so that the length of a highest frequency band element feed conductor 16 is equal for all highest frequency band antenna elements 14.

In order to achieve an acceptable gain, it is necessary to have more than one highest frequency antenna element 14. Four highest frequency antenna elements 14 give excellent highest frequency band antenna performance.

Figure 2:
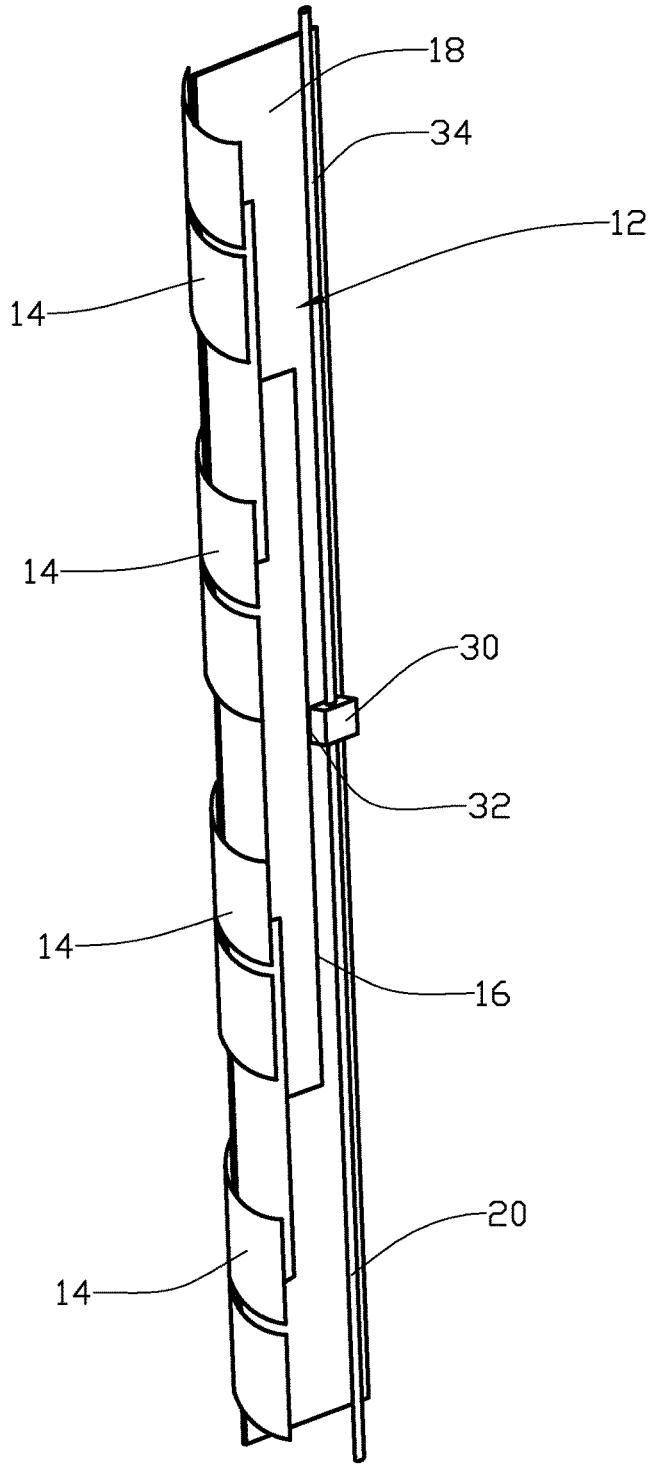
FIG. 2 shows a perspective view of an L band antenna of the whip antenna in FIG. 1.

A practical design of the highest frequency band antenna 12 is shown in FIG. 2. Here the highest frequency band element feed conductor 16 has the form of a printed circuit on a board 18.

The highest frequency band elements 14 are made from conductive plates and have the form of an arch of a circle.

A whip antenna feed conductor 20 is located at the opposite side of the board 18 relative the highest frequency band antenna elements 14. The highest frequency band antenna elements 14 are concave relative to the antenna feed conductor 20.

Figure 3:
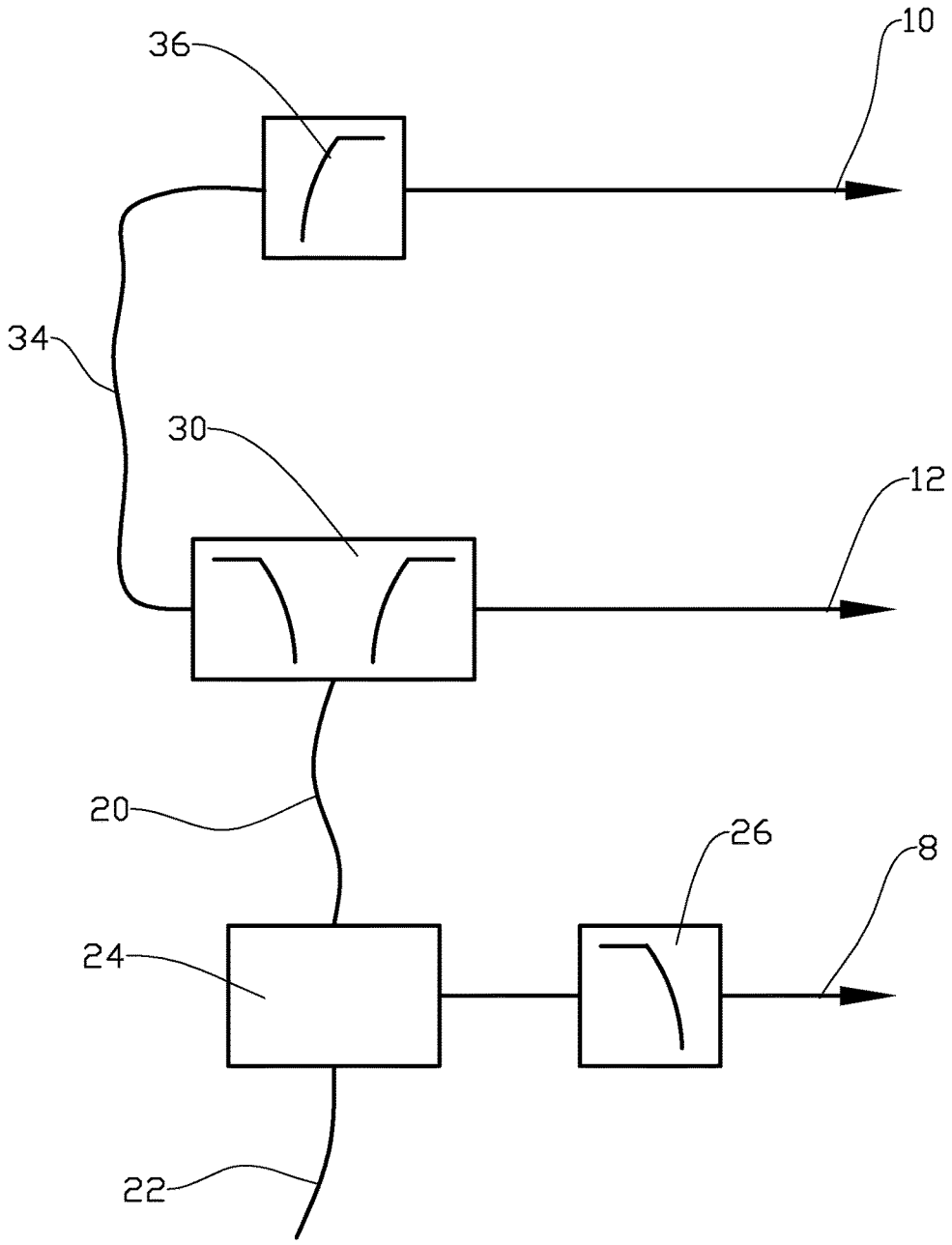
FIG. 3 shows a signal flow of the whip antenna in FIG. 1.

In this preferred embodiment, the three band signals to the antenna are combined prior to being supplied to the whip antenna 1 through a feed cable 22. In the base 4, a lower frequency band antenna matching unit 24 together with a lower frequency low pass filter 26 for the end feed lowest frequency antenna element 8 are positioned, see also FIG. 3.

The feed conductor 20 in this embodiment consists of a coaxial cable that includes a centre conductor and a shield. The shield of the feed conductor 20 constitutes, together with the spring 6 and a metal tube 28, the lowest frequency antenna element 8. The shield of the feed conductor 20 is electrically connected to the spring 6 and the metal tube 28 in order to improve radiation.

A diplexer 30, that includes an intermediate frequency low pass filter and highest frequency high pass filter, is positioned at a feed position 32 of the highest frequency band antenna 12. The diplexer 30 is connected to the highest frequency antenna feed conductor 16 and to a feed conductor 34, also in the form of a coaxial cable.

The feed conductor 34 supplies the intermediate frequency band antenna element 10 via an intermediate frequency high pass filter 36.

The shield of the feed conductors 20, 34 constitutes earth for the intermediate frequency and the highest frequency band antenna elements 10, 14.

The invention claimed is:

1. A three band whip antenna having a base and a whip tube connected to the base wherein the whip tube includes a highest frequency band antenna, an intermediate frequency band antenna above the highest frequency band antenna and a lowest frequency band antenna below the highest frequency band antenna, wherein the lowest frequency band antenna has a lowest frequency band antenna element which extends substantially along a whole length of the whip antenna, wherein the intermediate frequency band antenna has an intermediate frequency band antenna element which is included in the whip antenna along part of the length thereof and, wherein the highest frequency band antenna has at least one highest frequency band antenna element which is also included in the whip antenna along part of the length thereof and configured at a position closer to the base than the intermediate frequency band antenna element.

2. The three band whip antenna according to claim 1, wherein the highest frequency band antenna has more than one antenna element.

3. The three band whip antenna according to claim 2, wherein the more than one highest frequency band antenna elements are spaced along a part of the whip antenna.

4. The three band whip antenna according to claim 2, wherein the highest frequency band antenna elements are positioned diametrically opposite to a feed conductor.

5. The three band whip antenna according to claim 2, wherein the highest frequency band antenna elements are placed symmetrically along the whip antenna relative to a feed position thereof.

6. The three band whip antenna according to claim 2, wherein the highest frequency band antenna elements are formed as an arch of a circle.

7. The three band whip antenna according to claim 2, wherein the highest frequency band antenna elements are concave with respect to the feed conductor.

8. The three band whip antenna according to claim 1, wherein at least two of the lowest frequency, intermediate frequency or the highest frequency band signals are combined prior to or in the base.

9. The three band whip antenna according to claim 1, wherein at least two of the lowest frequency, intermediate frequency or the highest frequency band signals are divided prior to feeding the antenna elements to which the signals are fed.

10. The three band whip antenna according to claim 1, wherein signals to the intermediate frequency band antenna element and the highest frequency band antenna are passed through a single coaxial cable, wherein the single coaxial cable forms part of a radiating element for the lowest frequency band antenna element.

11. The three band whip antenna according to claim 10, wherein the highest frequency band antenna includes a diplexer which is connected to the single coaxial cable.

12. The three band whip antenna according to claim 1, wherein the intermediate frequency band antenna element and the highest frequency band element are provided with the lowest frequency band antenna element.

13. The three band whip antenna according to claim 1, wherein the lowest frequency band antenna element operates in the L-VHF band, the intermediate frequency band antenna element operates in the UHF band and the highest frequency band antenna operates in the L band.

* * * * *